US005547404A

United States Patent [19]

Nellis, Jr. et al.

[11] Patent Number: 5,547,404

[45] Date of Patent: Aug. 20, 1996

[54] FIXED SPACER HOT LINE TAP

[75] Inventors: Robert A. Nellis, Jr., Staatsburg; Robert V. DeFrance, Poughkeepsie; Richard R. Matlock, Catskill, all of N.Y.

[73] Assignee: Fargo Mfg. Company Inc., Poughkeepsie, N.Y.

[21] Appl. No.: 467,205

[22] Filed: Jun. 6, 1995

[51] Int. Cl.[6] ..... H01R 4/30

[52] U.S. Cl. ..... 439/803; 439/786; 439/812

[58] Field of Search ..... 439/803, 810, 439/811, 812, 813, 814, 815, 819, 778, 786, 788

[56] References Cited

U.S. PATENT DOCUMENTS

| | | | |
|---|---|---|---|
| 3,132,914 | 5/1964 | Wengen | 439/803 X |
| 3,830,427 | 8/1974 | Polidori | 439/803 X |
| 5,004,437 | 4/1991 | Walter et al. | 439/811 |
| 5,021,014 | 6/1991 | Walter et al. | 439/812 X |

FOREIGN PATENT DOCUMENTS

| | | | |
|---|---|---|---|
| 1362065 | 4/1964 | France | 439/811 |
| 2219716 | 7/1973 | Germany | 439/811 |
| 1029282 | 7/1983 | Russian Federation | 439/803 |

*Primary Examiner*—Jes F. Pascua

*Attorney, Agent, or Firm*—Kane, Dalsimer, Sullivan, Kurucz, Levy, Eisele and Richard, LLP

[57] ABSTRACT

A fixed spacer hot line tap has a body with a base and a run-conductor groove. An eyebolt passes through the base and has a tip disposed between the base and the run-conductor groove. The eyebolt has a tip, on which is attached an extender having at least one spline on an outer surface thereof and a tip. The extender is directed through a hole in a spacer, and is press-fit therein because of the at least one spline. The spacer has an open volume defined by the foot, a first leg and a second leg, and a main transfer component, across which electric current passes from a run conductor to a tap conductor. A pad is disposed within the open volume by attachment to the tip of the extender, which reaches there through the hole in the foot. In use, a tap conductor is disposed between the pad and the main transfer component, and is secured there by a tightening of the eyebolt. The tap conductor remains clamped there when the eyebolt is withdrawn because of the press-fit of the extender in the hole in the foot. The fixed spacer hot line tap with tap conductor may then be attached to a run conductor without any danger that the tap conductor will slip out during the attachment operation.

14 Claims, 8 Drawing Sheets

FIXED SPACER HOT LINE TAP

BACKGROUND OF THE INVENTION

1. Field of the Invention

The present invention relates to the field of electric power transmission, and, more specifically, is a connector for attaching a tap conductor to a line or run conductor.

2. Description of the Prior Art

Connectors of the subject type are old in the art. Prior-art connectors, for the most part, incorporate two-thread systems. One thread system is used to secure the tap conductor to the connector, and the other is used to secure the connector and tap conductor to the line or run conductor. It goes without saying that a two-thread system is undesirably complicated by including a large number of parts.

Clearly, a one-thread system would be thought to require a smaller number of parts and, as a consequence, to be simpler to manufacture and to use. However, with such a system, the same threaded bolt must secure the tap conductor to the connector, and the connector to the line or run conductor. Since the threaded bolt in such a situation cannot be completely tightened until the connector is to be secured to the run conductor, the tap conductor is to some degree loose during the installation of the connector onto the run conductor. This increases the likelihood that the tap conductor will slip out during this hazardous operation, causing the lineman to spend more time than is desirable to accomplish the connection. Even worse, the tap conductor could stray near the run conductor and draw an arc.

A connector having a one-thread system, but not having the above-noted disadvantages, would be a boon to the field of electric power transmission. Such is the object of the present invention.

SUMMARY OF THE INVENTION

To this end, the present invention is a fixed spacer hot line tap which includes a one-thread system for attaching a tap conductor to a run conductor. The fixed spacer hot line tap more importantly includes a fixed spacer within which a tap conductor may be secured and held while it is being attached to a run conductor.

More specifically, the fixed spacer hot line tap comprises a body which includes, at least, a base and a run-conductor groove, in which a run conductor is clamped, substantially opposite to the base. The base also includes a threaded hole through which a threaded eyebolt is screwed.

The end of the threaded eyebolt consequently disposed between the base and the run-conductor groove, that is, the end opposite to that having a ring or other means for gripping and turning the eyebolt, has a tip.

An extender is disposed on the tip of the eyebolt. The extender is substantially cylindrical in shape, and has at least one spline on an outer surface thereof, and a tip at the end opposite to that attached to the tip of the eyebolt.

The attachment of the eyebolt to the extender may be accomplished by providing the tip of the eyebolt with a portion of reduced radius, and the extender with a cavity having a rim of reduced radius to hold the tip. Such an arrangement permits the tip of the eyebolt to rotate within the cavity of the extender while the eyebolt is being turned.

A spacer having a foot, a first and a second leg, and a main transfer component, so-called because electric current passes thereacross between the run conductor and the tap conductor, is attached to the extender. The foot has a hole through which the extender is directed and is secured by a press-fit due to the at least one spline on the outer surface thereof. The tip of the extender reaches into an open volume defined by the foot, first leg, second leg and main transfer component of the extender.

A pad is finally disposed within the open volume in the spacer and attached to the tip of the extender. The pad may have a channel on its underside having an edge of narrowed width, while the tip of the extender may have a portion of reduced radius, for securing the pad within the open volume in the spacer by attachment to the tip of the extender.

In use, a tap conductor is placed in the open volume of the spacer. The eyebolt is then turned, compressing the spacer against the run-conductor groove of the body, compressing the tap conductor between the pad and the main transfer component, and forcing the extender through the hole in the foot of the spacer. Because of the press-fit between the extender and the hole, the tap conductor remains clamped between the pad and main transfer component when the eyebolt is turned in the opposite direction to move the spacer away from the run-conductor groove of the body. The fixed spacer hot line tap may then be attached to a run conductor without any danger that the tap conductor may slip out during the connection process.

The present fixed spacer hot line tap will now be described in more complete detail, with frequent references being made to the drawings, which are identified as follows.

DETAILED DESCRIPTION OF THE PREFERRED EMBODIMENT

Figure 1:
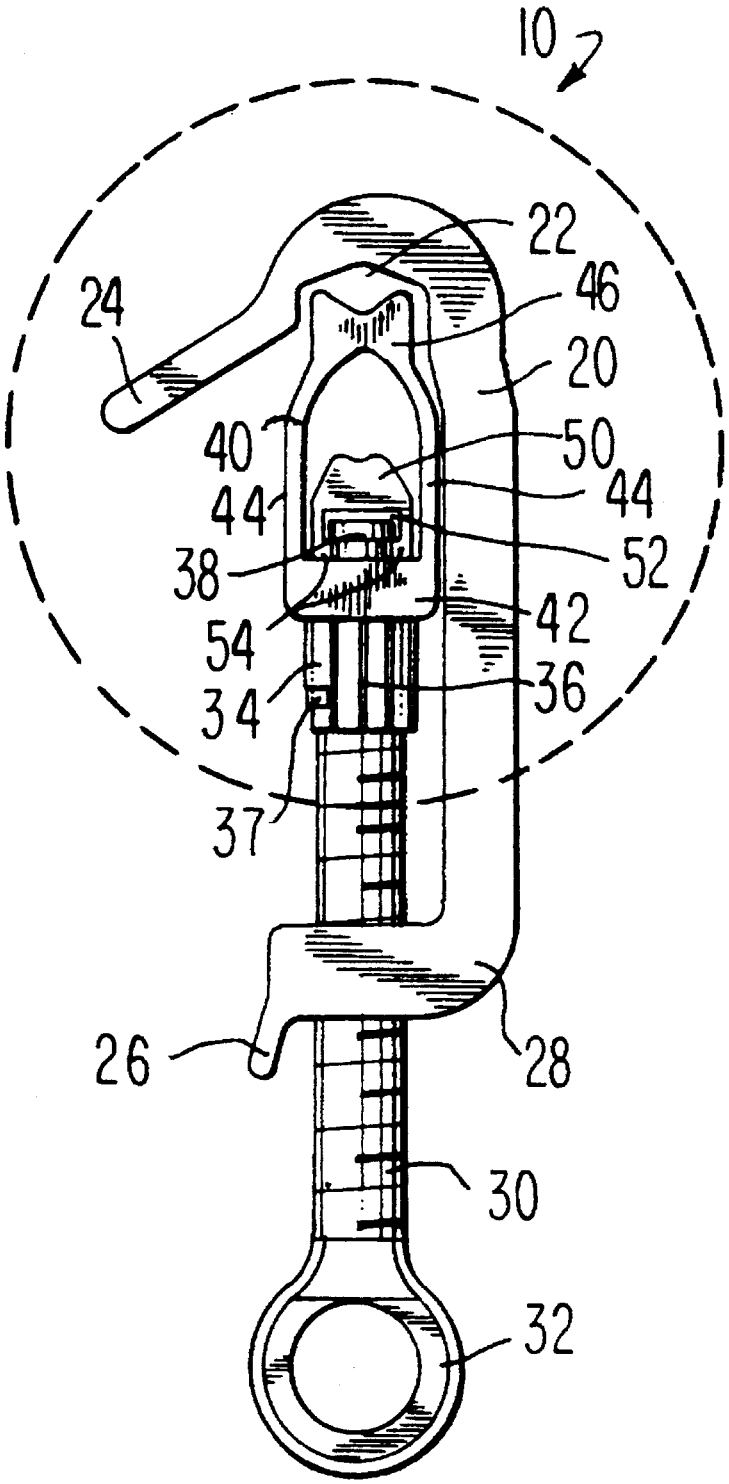
FIG. 1 is a side plan view of the fixed spacer hot line tap of the present invention.

Turning now to the several drawing figures, a side plan view of the fixed spacer hot line tap 10 is provided in FIG. 1. The fixed spacer hot line tap 10 comprises a body 20 having a run-conductor groove 22 (so-called for reasons to be made clear below), a duck-bill type guide 24, a shot-gun stick tab 26, and a base 28. The base 28 has a threaded hole through which an eyebolt 30 is engaged.

The eyebolt 30 includes a ring 32, which may be engaged by a suitable tool and turned during the installation or removal of the fixed spacer hot line tap 10 from a run conductor. At the other end of the eyebolt 30 is a splined extender 34. The splined extender 34 is attached to the tip of the eyebolt 30, which tip may rotate therewithin, specifically within a cavity in the splined extender 34.

The fixed spacer hot line tap 10 also includes a spacer 40 and a pad 50. The spacer 40 has a foot 42, a pair of legs 44, and a main transfer component 46, which together define an open volume housing the pad 50.

The splined extender 34 passes through a hole in the foot 42 of the spacer 40, and is press-fit therewithin by virtue of six raised teeth or splines 36, which extend longitudinally on the outer surface thereof. The splined extender 34 also has a tip 38 with a portion of reduced radius, which engages within a channel 52 on the underside of the pad 50. Channel 52 has edges 54 of reduced width to secure tip 38 of splined extender 34.

Figure 2:
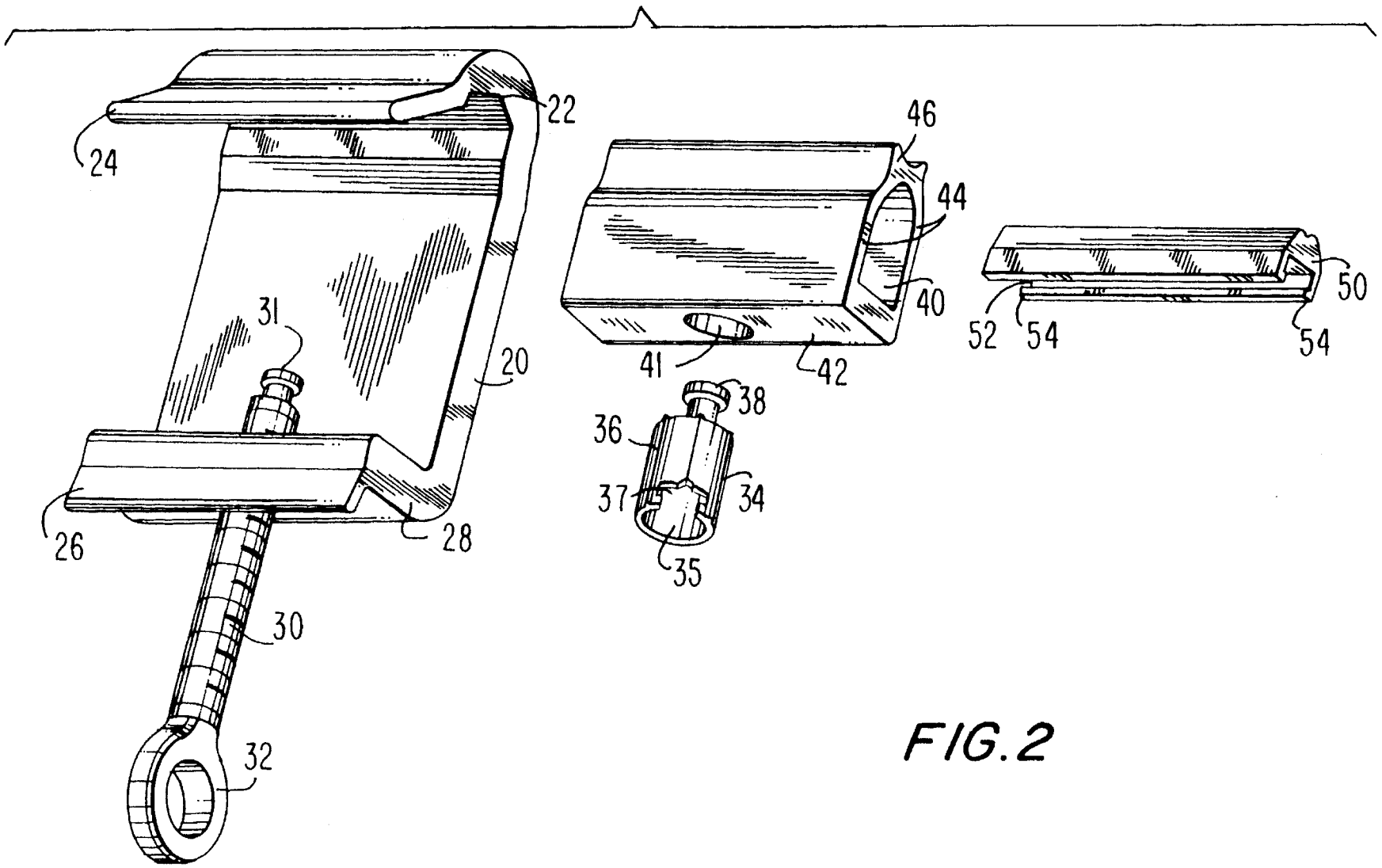
FIG. 2 is an exploded perspective view thereof.

An exploded perspective view of the fixed spacer hot line tap 10 is shown in FIG. 2. Eyebolt 30 has a tip 31, with a portion of slightly reduced radius adjacent thereto.

Splined extender 34 has a cavity 35, which has a rim of slightly reduced radius. Splined extender 34 also has an opening 37 which affords access to cavity 35. Tip 31 of eyebolt 30 is disposed within the cavity 35 of splined extender 34 through the opening 37, and is freely rotatable therewithin.

Foot 42 of spacer 40 has a hole 41 of diameter such that splined extender 34 may be press-fit therewithin. Initially, splined extender 34 is press-fit into hole 41 so that tip 38 and the portion of reduced radius adjacent thereto are disposed within the volume of the spacer 40. Pad 50 is then slid onto tip 38, which may be of a dimension such that a tight fit is obtained. Further, the opening 37 of the splined extender 34 is preferably oriented outward away from body 20, as shown in FIGS. 1 and 2, to prevent the spacer 40, pad 50 and splined extender 34 from slipping from the tip 31 of the eyebolt 30.

Figure 3:
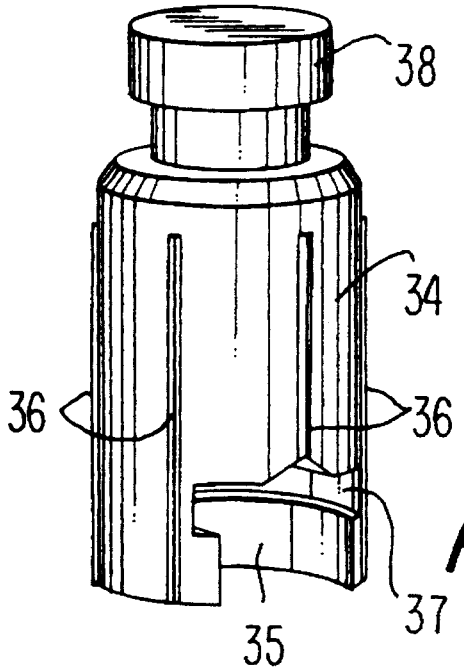
FIG. 3 is a perspective view of the splined extender component of the present invention.
Figure 4:
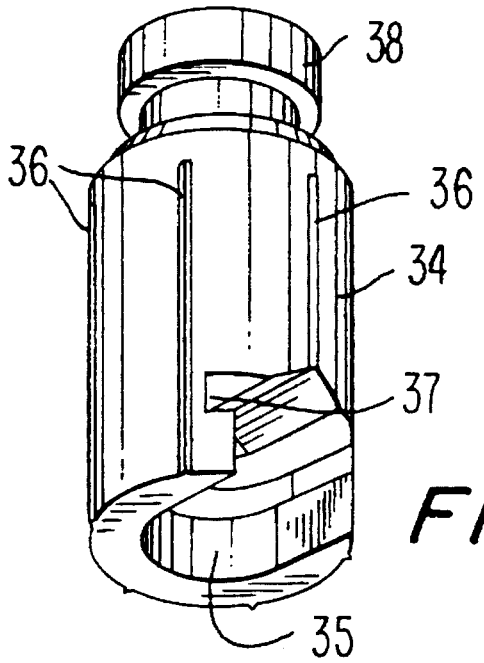
FIG. 4 is another perspective view of the splined extender component.

Turning now to FIGS. 3 and 4, two perspective views, taken from two different directions, of the splined extender 34 are shown. In FIGS. 3 and 4, splined extender 34 may be seen to have a cavity 35 with a rim of slightly reduced radius to hold tip 31 of eyebolt 30. Access for tip 31 into cavity 35 is afforded by opening 37.

Splined extender 34 has a plurality, perhaps six, of raised teeth or splines 36 extending longitudinally on the outer surface thereof. And, as previously mentioned, splined extender 34 includes a tip 38, separated from the splined portion of the splined extender 34 by a portion of reduced radius. Tip 38 ultimately is disposed within channel 52 in pad 50.

Splined extender 34 may be of die cast aluminum; eyebolt 30 may be of forged aluminum; and body 20, spacer 40 and pad 50 may be extruded from a strong aluminum alloy.

Figure 5:
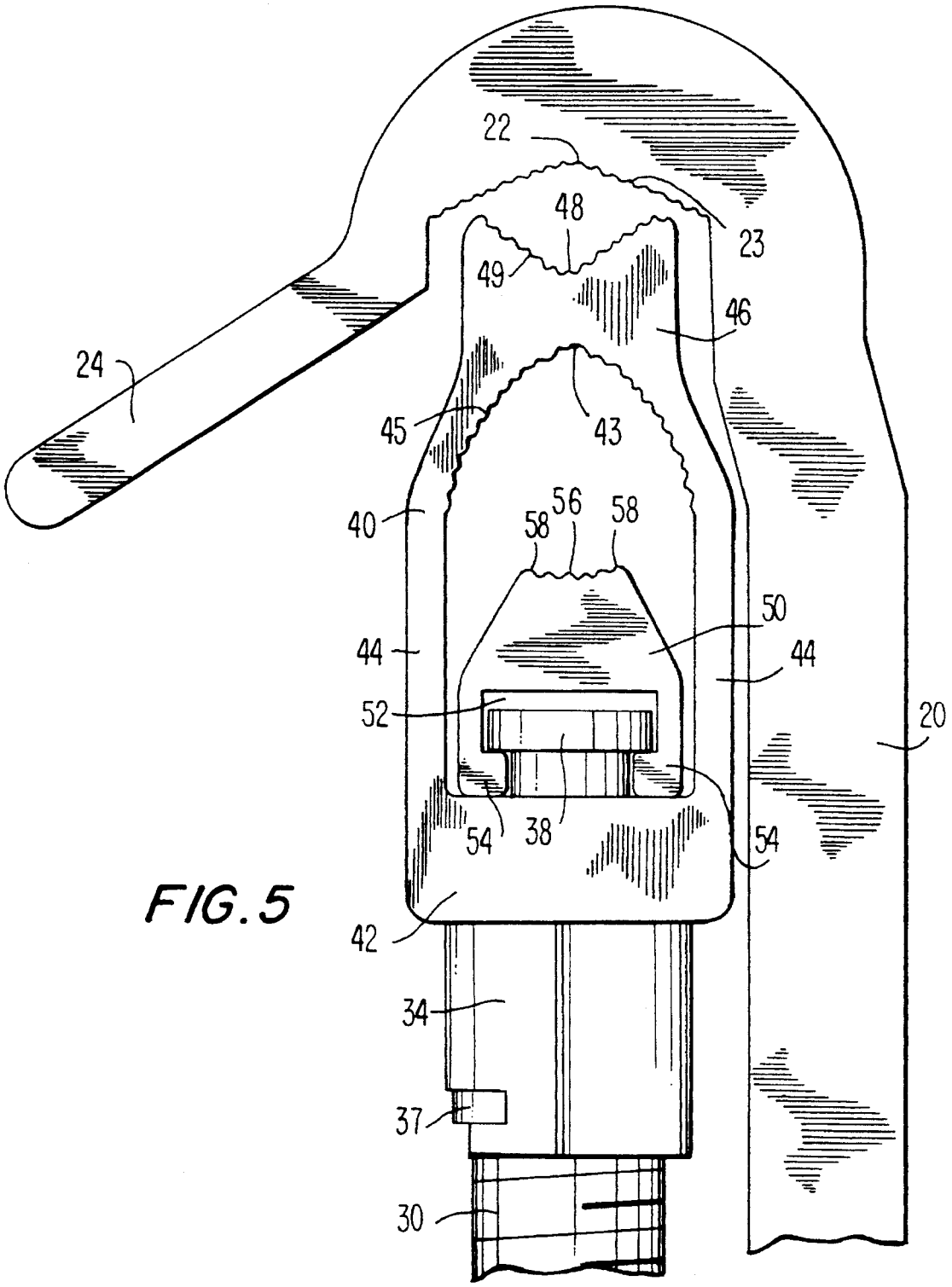
FIG. 5 is a detailed, enlarged side plan view of the circled portion of FIG. 1.

FIG. 5 is a detailed, enlarged view of the circled portion of FIG. 1. As may be observed, the surface adjacent to and on either side of run-conductor groove 22 of body 20 includes rounded teeth 23. As the body 20 may be extruded, rounded teeth 23 run parallel to the run-conductor groove 22.

In like manner, main transfer component 46 of spacer 40 has a run-conductor groove 48. Adjacent thereto and on either side thereof are rounded teeth 49. As the spacer 40 may be extruded, rounded teeth 49 run parallel to the run-conductor groove 48.

Within the volume defined by the foot 42, legs 44 and main transfer component 46 of spacer 40, on the inside of the main transfer component 46, is a tap-conductor groove 43. Adjacent thereto and on either side thereof are rounded teeth 45, which may run parallel to tap-conductor groove 43, as the spacer 40 may be extruded.

Pad 50 also has a tap-conductor groove 56, adjacent to which are rounded teeth 58; rounded teeth 58 may run parallel to tap-conductor groove 56, as the pad 50 may be extruded.

Figure 6:
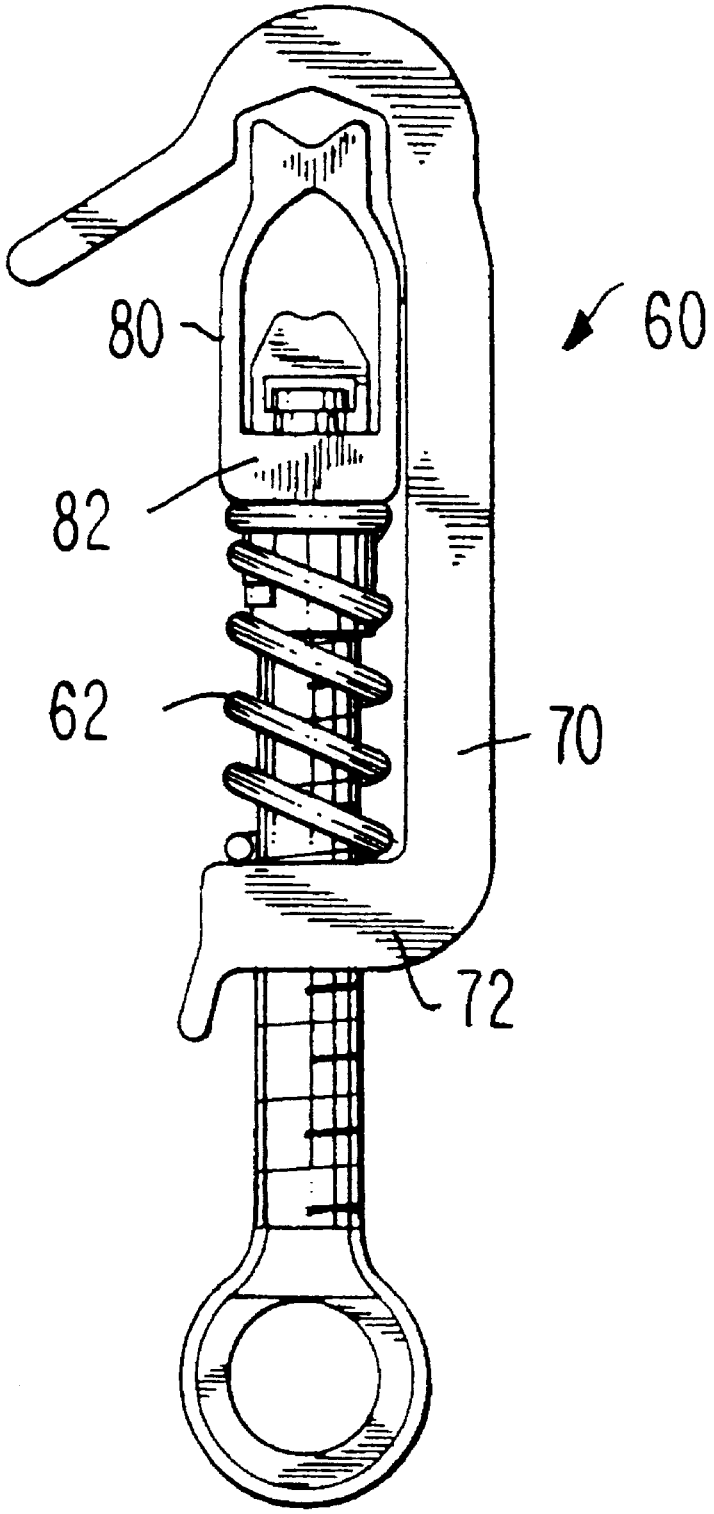
FIG. 6 is a side plan view of an alternate embodiment of the present invention.

FIG. 6 is a side plan view of an alternate embodiment of the fixed spacer hot line tap 60 of the present invention. It differs only by the inclusion of a spring 62 compressed between the base 72 of body 70 and the foot 82 of spacer 80. When included, spring 62 helps to keep the components of the fixed spacer hot line tap 60 in alignment during installation.

Figure 7:
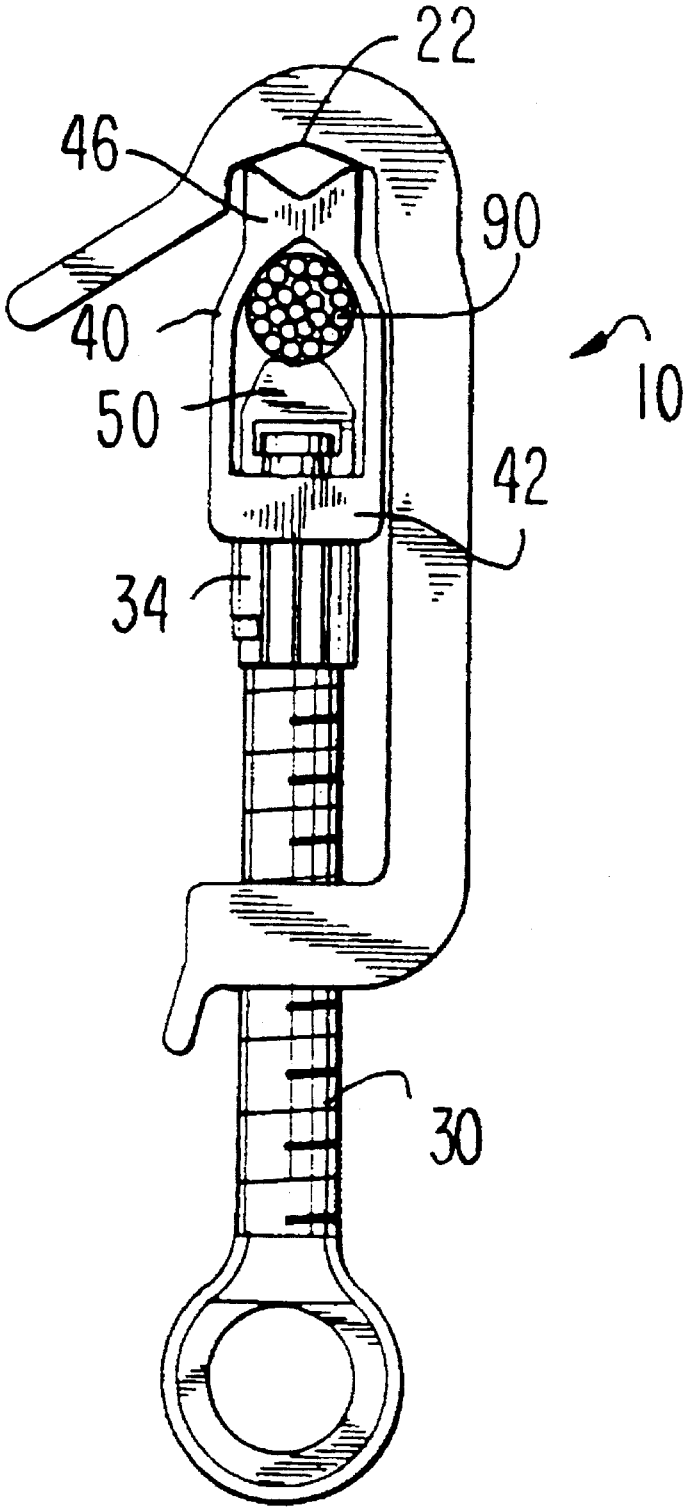
FIG. 7 is a side plan view of the fixed spacer hot line tap attached to a tap conductor.

FIG. 7 is a side plan view of the fixed spacer hot line tap 10 with a tap conductor 90, shown in cross section, in its intended position between pad 50 and main transfer component 46. Since tap conductor 90 most often comprises a cable of twisted wire strands, rounded teeth 45 and rounded teeth 56 cut across individual wire strands to grip the tap conductor 90 effectively.

Tap conductor 90 is secured as shown by placing it within spacer 40, and by tightening eyebolt 30 until spacer 40 compresses against run-conductor groove 22 and pad 50 compresses the tap conductor 90 against the underside of the main transfer component 46. While the eyebolt 30 is being so tightened, the splined extender 34 is forced through hole 41 in foot 42 of spacer 40, whereby the splines 36 ensure a tight press-fit therewithin. Tip 31 of eyebolt 30, it will be recalled, rotates within cavity 35 of splined extender 34. Once the tap conductor 90 is clamped as shown in FIG. 7, it cannot be readily removed, as the splined extender 34 is tightly press-fit within the hole 41 in foot 42 of the spacer 40. One or two turns of eyebolt 30 may be all that is required to effect the press-fit, once the spacer 40 contacts the run-conductor groove 22. Eyebolt 30 may then be turned in the opposite direction to withdraw the spacer 40 relative to run-conductor groove 22, while tap conductor 90 remains fixed between spacer 40 and pad 50. Because the spacer 40 remains fixed relative to the pad 50 once the tap conductor 90 has been secured therein, the present invention is referred to as a "fixed spacer" hot line tap 10.

Figure 8:
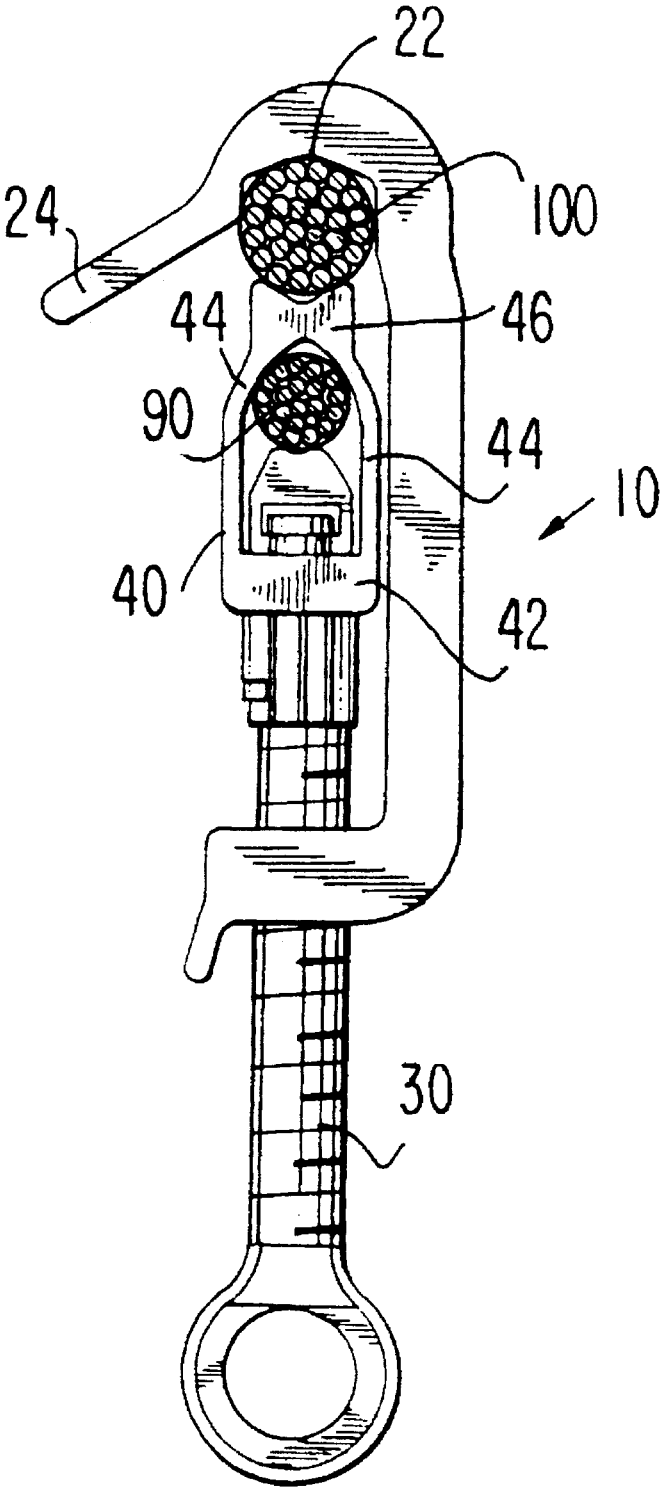
FIG. 8 is a side plan view similar to that given in FIG. 7, but wherein the fixed spacer hot line tap is further attached to a run conductor.

FIG. 8 is a side plan view of the fixed spacer hot line tap 10 shown in FIG. 7 attached to a run conductor 100, shown in cross section, in its intended position between main transfer component 46 and run-conductor groove 22. Since the run conductor 100 most often comprises a cable of twisted wire strands, rounded teeth 23 and rounded teeth 49 cut across individual wire strands to grip the run conductor 100 effectively.

Run conductor 100 is secured as shown by hanging the fixed spacer hot line tap 10, including tap conductor 90, thereonto, and by tightening eyebolt 30 to compress run conductor 100 between main transfer component 46 and run-conductor groove 22. Duck-bill type guide 24 and leg 44 of spacer 40 guide the run conductor 100 into proper position during this operation. The fixed spacer hot line tap 10 may be held in position by shot-gun stick tab 26 on the run conductor 100 while eyebolt 30 is being tightened. A shot-gun stick may be attached to shot-gun stick tab 26 and used to slap the fixed spacer hot line tap 10 quickly onto the run conductor 100 to avoid drawing an arc.

As may be understood from FIG. 8, main transfer component 46 is so called because current is transferred thereacross from the run conductor 100 to the tap conductor 90. Legs 44 and foot 42 of spacer 40 act to quickly conduct and radiate heat away from main transfer component 46.

Figure 9:
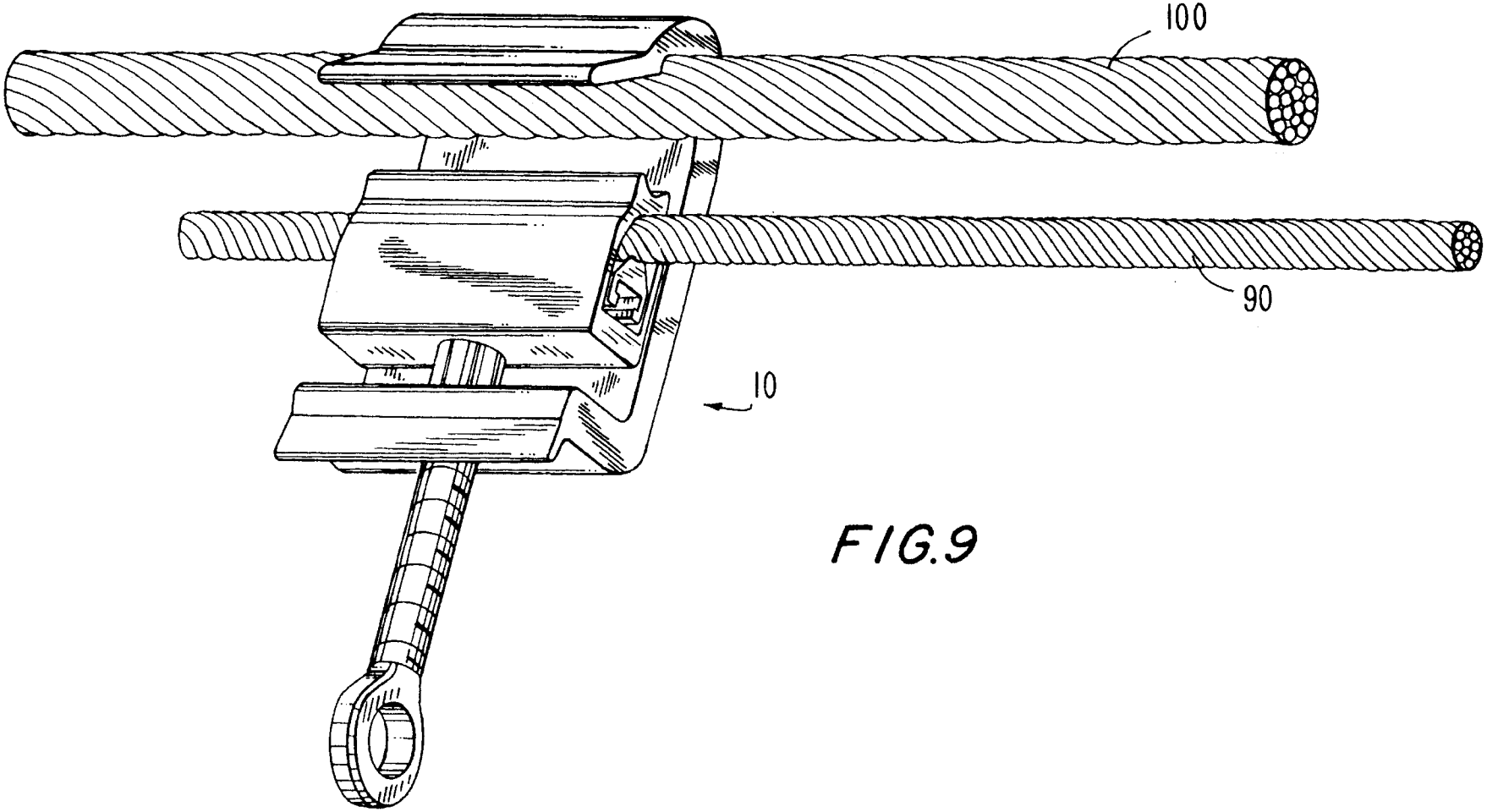
FIG. 9 is a perspective view of the fixed spacer hot line tap shown in FIG. 8.

FIG. 9 is a perspective view of the fixed spacer hot line tap 10 in use attaching a tap conductor 90 to a run conductor 100.

While particular embodiments of the present invention have been shown and described, it is clear that various changes and modifications may be made. It is therefore intended in the following claims to cover all modifications and changes as may fall within the true spirit and scope of the invention.

What is claimed is:

1. A fixed spacer hot line tap comprising:

a body, said body including a base and a run-conductor groove substantially opposite to said base, said base further having a threaded hole therethrough;

an eyebolt, said eyebolt being screwed through said threaded hole in said base, said eyebolt having a tip at one end, said end with said tip being disposed between said run-conductor groove and said base of said body;

an extender on said tip of said eyebolt, said extender being attached to said tip of said eyebolt and having at least one spline on an outer surface thereof;

a spacer, said spacer comprising a foot, a first leg and a second leg, and a main transfer component together defining an open volume, said foot including a hole through which said extender is passed and secured in a press fit by said at least one spline, said tip of said extender being within said open volume in said spacer; and a pad, said pad being within said open volume in said spacer and being attached,to said tip of said extender, whereby, when said eyebolt is tightened, a tap conductor may be secured between said pad and said main transfer component within said open volume in said spacer, and may remain secured when said eyebolt is loosened by virtue of said press fit between said extender and said hole in said foot of said spacer, and a run conductor may be secured between said main transfer component and said run-conductor groove of said body.

2. A fixed spacer hot line tap as claimed in claim 1 further comprising:

a spring, said spring being disposed about said eyebolt and being compressed between said base of said body and said foot of said spacer.

3. A fixed spacer hot line tap as claimed in claim 1 wherein said run-conductor groove of said body includes a plurality of rounded teeth for gripping a run conductor.

4. A fixed spacer hot line tap as claimed in claim 1 wherein said body further comprises a duck-bill type guide for guiding a run conductor into said run-conductor groove.

5. A fixed spacer hot line tap as claimed in claim 1 wherein said body further comprises a shot-gun stick tab whereby said fixed spacer hot line tap may be attached to a shot-gun stick.

6. A fixed spacer hot line tap as claimed in claim 1 wherein said tip of said eyebolt includes a portion of reduced radius, and wherein said extender has a cavity with a rim of reduced radius to hold said tip of said eyebolt, said extender further having an opening in said outer surface thereof for inserting said tip of said eyebolt into said cavity.

7. A fixed spacer hot line tap as claimed in claim 1 wherein said extender has a plurality of splines on said outer surface thereof.

8. A fixed spacer hot line tap as claimed in claim 7 wherein said plurality is six.

9. A fixed spacer hot line tap as claimed in claim 1 wherein said tip of said extender includes a portion of reduced radius, and wherein said pad includes a channel having edges of reduced width to secure said tip of said extender therein.

10. A fixed spacer hot line tap as claimed in claim 1 wherein said main transfer component of said spacer has a run-conductor groove and, within the open volume thereof, a tap-conductor groove.

11. A fixed spacer hot line tap as claimed in claim 10 wherein said run-conductor groove of said main transfer component of said spacer has a plurality of rounded teeth for gripping a run conductor.

12. A fixed spacer hot line tap as claimed in claim 10 wherein said tap-conductor groove of said main transfer component of said spacer has a plurality of rounded teeth for gripping a tap conductor.

13. A fixed spacer hot line tap as claimed in claim 1 wherein said pad has a tap-conductor groove.

14. A fixed spacer hot line tap as claimed in claim 13 wherein said tap-conductor groove of said pad has a plurality of rounded teeth for gripping a tap conductor.

* * * * *